US007803431B2

(12) United States Patent
Tijink et al.

(10) Patent No.: US 7,803,431 B2
(45) Date of Patent: Sep. 28, 2010

(54) METHOD FOR COATING A YARN

(75) Inventors: Freddy M. J. Tijink, Oldenzaal (NL); Henricus H. W. Feijen, Velp (NL); Ronald Stiefelhagen, Maarsbergen (NL); Christian Vieth, Wörth (DE); Johannes P. M. Dortmans, Rozendaal (NL)

(73) Assignee: DSM IP Assets B.V., Heerlen (NL)

( * ) Notice: Subject to any disclaimer, the term of this patent is extended or adjusted under 35 U.S.C. 154(b) by 1000 days.

(21) Appl. No.: 10/593,239

(22) PCT Filed: Mar. 12, 2005

(86) PCT No.: PCT/EP2005/002668

§ 371 (c)(1),
(2), (4) Date: Sep. 18, 2006

(87) PCT Pub. No.: WO2005/093142

PCT Pub. Date: Oct. 6, 2005

(65) Prior Publication Data

US 2007/0196651 A1 Aug. 23, 2007

(30) Foreign Application Priority Data

Mar. 18, 2004 (EP) ..... 04006473

(51) Int. Cl.
*C08J 7/04* (2006.01)

(52) U.S. Cl. ..... 427/513

(58) Field of Classification Search ..... 428/375; 264/446; 442/59, 457, 487, 501, 508, 513, 442/538, 541, 226
See application file for complete search history.

(56) References Cited

U.S. PATENT DOCUMENTS

| | | | |
|---|---|---|---|
| 3,407,092 | A | 10/1968 | Gage et al. |
| 4,197,345 | A | 4/1980 | Worral |
| 5,142,754 | A | 9/1992 | Krenzer |
| 5,165,993 | A | 11/1992 | Van Anholt et al. |
| 5,573,850 | A | 11/1996 | Cunningham et al. |
| 5,625,976 | A | 5/1997 | Goodale |
| 5,879,758 | A | 3/1999 | Goodale |
| 6,682,816 | B1 | 1/2004 | Wang |

FOREIGN PATENT DOCUMENTS

| | | |
|---|---|---|
| DE | 40 02 109 | 8/1990 |
| DE | 198 50 026 | 5/2000 |
| EP | 0 136 727 | 4/1985 |
| FR | 2 105 086 | 4/1972 |
| WO | WO 95/32618 | 12/1995 |

OTHER PUBLICATIONS

International Search Report, mail date from EPO Jun. 17, 2005.

*Primary Examiner*—Arti Singh-Pandey
(74) *Attorney, Agent, or Firm*—Nixon & Vanderhye P.C.

(57) ABSTRACT

A method for coating yarn is proposed, including steps in which the yarn is first placed in contact with a dispersion of the coating agent in a dispersing agent or with the coating agent in melted form, optionally excess dispersion or melt is scraped back off the yarn, and then the coating is formed on the yarn, where in the case of the dispersion this occurs by means of at least partially removing the dispersing agent by heating, and the yarn thus coated is then cooled down and wound, which is distinguished by the fact that the coated yarn undergoes additional cooling before winding.

20 Claims, No Drawings

METHOD FOR COATING A YARN

CROSS-REFERENCE TO RELATED APPLICATION

This is a U.S. National Phase Application of Application No. PCT/EP2005/002668 filed Mar. 12, 2005. The disclosure of the prior application is hereby incorporated by reference herein in its entirety.

BACKGROUND

The aim of the present invention is a method for coating yarn, including steps in which the yarn is first placed in contact with a dispersion of the coating agent in a dispersing agent or with the coating agent in melted form, optionally excess dispersion or melt is scraped back off the yarn, and then the coating is formed on the yarn, where in the case of the dispersion this occurs by means of at least partially removing the dispersing agent by heating, and the yarn thus coated is then cooled down and wound.

Such a method is known. For example, U.S. Pat. No. 3,407,092 describes such a coated yarn that is obtained by guiding a nylon yarn through a bath of an emulsion containing an acrylate-based copolymer in aqueous emulsion and then drying for two minutes at about 93° C. This yarn is then cooled and twisted. About 1 to 10 wt. %. coating agent is applied to the yarns of U.S. Pat. No. 3,407,092.

Coating of fabrics such as wovens, knits, paper, and nonwovens is also known. Generally this manner of coating is understood to mean applying a film coating of natural or synthetic materials, as a coating compound, to fabric or backing, with the goal of making them suitable for special requirements or imparting new properties to them, for example for imitation leather, covers, tarpaulins, etc. By combining suitable fabric or backings and coatings, finished products can be obtained with completely new properties, where the fabric is primarily responsible for the mechanical strength of the final product while the applied coating determines the behavior of the material for use against outside influences, such as breathability, burst strength and scratch resistance, lightfastness and chemical resistance, flame retardancy, water resistance, heat resistance, as well as the appearance, such as printing, dyeing, graining, and the particular applicability.

Generally the coating is spread on the backing as a uniformly thick layer using a "doctor knife". The thickness of the coating is adjusted according to the particular purpose and can be equal to a fraction of a millimeter as well as several millimeters. This way of applying a coating is known to the person skilled in the art, and does not need to be further discussed here.

Regarding formation of the coating, note that good adhesion of the coating to the backing often is only ensured if first a priming coat is applied, using a very small amount of coating. After intermediate drying, the proportionately heavier layer is applied and optionally even a third "finishing layer", also called a topcoat, is applied (the latter in particular to ensure scratch resistance).

Thus, the process of coating fabrics can certainly consist of several steps, over the course of which often relatively large amounts of coating agent are employed. This generally also additionally includes the fabric production step itself, and so for example production of fabrics from yarns etc.

Thus, it would be desirable if at least part of the coating method could be already carried out in upstream process steps and so, for example, just before the weaving step. Then the coated yarns could be directly processed into coated fabrics, resulting in a uniform and durable coating of the woven material just by application of heat and/or pressure, for example by hot pressing.

It would also be expedient if, for example, a partial coating was already present on the yarns or in the woven material, so that just one or perhaps two coating steps had to be carried out on the finished fabric.

Many attempts have been made to provide the yarns with coatings before they are further processed into fabrics, such as is done, for example, in U.S. Pat. No. 3,407,092 cited above.

Unfortunately, the known methods for coating yarns always have still had drawbacks which have limited their applicability. Thus, often the amount of coating applied to the yarns is too small to be an equivalent replacement for only coating the fabric afterward. Even the amount applied in U.S. Pat. No. 3,407,092, at 1 to 10 wt. %, is too small.

The uniformity of yarns obtained by direct coating often is also often too poor, both with regard to the amount of coating and with regard to the shape of the coated yarns obtained in this manner. Often yarns are obtained that are not uniformly round or flattened, which can be processed further only with difficulty, for example on looms. Of course, this problem arises to a greater extent when large amounts of coating agent are applied.

In addition, the speed of application of the coating on the yarns is also a problem, since first of all at high speeds the applied coating is nonuniform and/or too light, while at low speeds the process is uneconomical. Within the present invention, speed is understood to mean the length of yarn that comes in contact with the coating agent per unit time.

SUMMARY

The aim of the present invention is therefore to provide another method for coating yarns that at least reduces the problems described above.

It has now been surprisingly discovered that the goal according to the invention is achieved by means of a method, as described in the introductory paragraph, that is distinguished by the fact that the coated yarn undergoes additional cooling before winding.

By means of this relatively simple measure, yarns are obtained that not only have a coating applied uniformly and in large quantity, but are also very well suited for further processing with regard to their uniformly round shape. After coating according to the invention, multifilament yarns then behave like monofilament yarns, which has a very advantageous effect, for example, on their travel behavior.

The yarn, which is still relatively hot because of formation of the coating by means of heat or by contact with the coating agent in melted form, besides being cooled by ambient air is therefore additionally cooled, where a water-cooled entanglement jet has in particular proven to be useful for this purpose.

EMBODIMENTS

Within the scope of this invention, yarn is understood to mean the conventional name for "a practically endless filamentary entity made from finite fibers or from one or more practically endless filaments."

Within the scope of this invention, dispersion is understood to mean a finely divided distribution of a material in another material. The degree of dispersion can range from coarsely disperse systems with an average particle size of $>10^{-6}$ m, through colloidally disperse systems with an average particle size of between $10^{-6}$ m and $10^{-9}$ m, up to molecularly disperse systems (a particle size of $<10^{-10}$ m). Within the scope of this invention, generally liquid dispersing agents and solid or liquid dispersed components are used. Such dispersions are known to the person skilled in the art as emulsions or sols.

The method according to the invention is particularly advantageously suitable as a component of a draw or spin-draw process, where it can be incorporated into the process flow. In order to make the method more economical, it is suggested that, in the case when the dispersing agent is removed, the required heat be supplied during the relaxation step which is necessary anyway in the draw process. In this way the desired coating and the target yarn properties are simply and advantageously adjusted.

In a preferred embodiment, contact is made between the yarn and the dispersion or the coating agent in melted form by guiding the yarn through the dispersion or the melt.

Here it has in particular proven to be useful if the dispersion of the coating agent or the coating agent in melted form is in a container through which the yarn is guided, for example by means of rolls. Immediately after leaving the container, the yarn can then be guided through a scraper, for example in the form of a round opening with adjustable diameter. By means of this embodiment, of the scraper as an adjustable "aperture", the amount of dispersion or coating agent in melted form to be scraped off can be adjusted very simply but effectively.

The particular advantage of this manner of applying the coating agent is that yarns can also be obtained that pick up only relatively small amounts of coating agent. Those yarns coated in this manner are exceptionally suitable, for example after the weaving process, as the substrate for application of a further coating step, during which additives such as adhesion activators and the like can be optionally added that otherwise could not be employed because of poor stability.

The process according to the invention therefore permits considerable flexibility in production of coated yarn or fabric.

Of course, other ways are also conceivable for applying the coating agent. Thus, the melt or the dispersion with the coating agent can also be applied by means of conventional and known treatment devices, for example by spraying them on or by using applicator rolls ("kiss rolls").

A further advantage of the method is that the yarn to be coated can also run through the coating agent untwisted, for example as adjacent multifilaments. Treatment of untwisted yarns is even desirable, since after making fabrics such as, for example, woven fabrics, from these untwisted coated yarns, very dense and closed woven fabrics can be obtained by application of pressure and temperature. Because of the relatively wide separation of individual filaments in the untwisted yarn compared with twisted yarn, the woven fabric is also more expanded. Thus quite excellent closure of the woven fabric results, which can be utilized quite well for a number of applications. Additionally, the woven fabric obtained in this manner is also relatively thin compared to wovens obtained from coated and twisted yarns.

In another preferred embodiment, the yarns are treated by the coating method according to the present invention in the form of single filaments or monofilaments. By coating single filaments with the coating agent, a core-and-sheath structure is formed of the type obtained by bicomponent spinning (which is considerably more expensive), where the coating agent forms the sheath component. Then these single filaments, coated in this way, are again combined and treated with heat and optionally also with pressure, the sheath components are melted on, and a practically totally closed wrap is constructed around the core components formed by the filaments. The structures obtained in this way are distinguished by the absence of undesirable wick effects (wicking). Thus, the method according to the invention is quite suitable for production of "low-wick" or preferably "no-wick" yarns.

The yarns to be coated are advantageously yarns made from thermoplastic polymers such as polyamide, polyester, or polyolefin as well as blends or copolymers thereof.

Of course, it is also possible to treat other types of yarns in the manner according to the invention, for example yarns made from natural fibers or solvent-spun yarns.

The good suitability of thermoplastics for the claimed method, however, is based on the fact that it can be easily integrated into typical melt-spinning processes with added or downstream drawing equipment.

Yarns that consist essentially of polyethylene terephthalate are particularly preferred, because of their frequent use in coated fabrics.

Preferably the coating is carried out continuously with yarn speeds between 50 and 1000 m/mm.

Suitable coating agents in principle are all materials that can be melted and/or dispersed. Within the scope of the present invention, however, it is particularly preferred for the coating agent to be a polymer selected from the group containing silicone, polyurethane, polyolefin, polyacrylate, and polyvinyl compounds as well as copolymers and blends thereof.

Even more preferred are coating agents consisting essentially of polyvinyl chloride.

So it is desirable for the dispersing agent to be water, especially from environmental and cost standpoints.

The method according to the invention makes it possible to obtain reproducible and uniform amounts of coating agent applied to the yarns between 1 and 800 wt. %, preferably between 10 and 500 wt. %, even more preferably between 50 and 400 wt. %, in quite adjustable amounts.

An aim of the present invention is additionally a coated yarn that can be obtained by the method according to the invention, as well as fabric, such as woven or nonwoven fabric containing yarns coated in this manner.

An aim of the present invention is also a coated yarn or fabric obtainable from such yarn for which the coating agent is selected so that the thus obtained coated yarn or fabric has increased transparency.

Materials made from partially crystalline polymers such as, for example, polyethylene terephthalate (PET), are themselves transparent, since their morphology is made up of crystals which are much smaller than the wavelength of visible light. Hence, for example, the walls of PET bottles made from partially crystalline PET are transparent. But if the partially crystalline polymers are present in the form of yarns or filaments, then these yarns behave like large lenses due to their very small diameter and the difference between the refractive indices of air and the yarn. This high refraction of light is the reason that a bundle of yarn appears opaque.

This problem is solved by coating the yarn with a coating agent that has a refractive index very close to the refractive index of the yarn to be coated. The difference between the refractive index of the coating agent, measured at the wavelength of the D line of sodium, and the refractive index of the yarn is preferably no more than 0.01, even more preferably no more than 0.001.

Suitable coating agents for yarns based on polyethylene terephthalate are, for example, PVC, polyurethanes, polydimethylsiloxanes, and also polystyrenes and silicones or mixtures of the indicated polymers.

In the case of (partially) drawn yarns, another problem arises where the drawn (and therefore oriented) yarns, particularly industrial yarns, exhibit high double refraction (birefringence). Double refraction indicates the phenomenon that the propagation velocity and thus the refractive index of a material depends on the direction of oscillation for incident light. Double refraction is based on the fact that the (oriented) molecules or the molecular lattice of the material in question have different polarizabilities in different directions. As a result, circularly polarized natural light, which can be considered as the superposition of two mutually perpendicular linearly polarized rays, when refracted in the material is decomposed into two separate rays with different refractive indices. Double refraction appears in all crystals that do not belong to the regular system and is thus a measure of molecular orientation, for example in drawn polymers.

The idea is now to first determine the refractive indices of both mutually perpendicular, linearly polarized rays, to determine an isotropic refractive index for the material from them, and then to correlate the isotropic refractive index determined in this manner with the coating agent as described above.

In the case of a highly drawn polyethylene terephthalate yarn, for example, the refractive indices of the two mutually perpendicular rays are 1.73 and 1.55 at the sodium wavelength. From this, we get an isotropic index for the yarn of 1.61, from which we again find a refractive index for the coating agent in the range from 1.60 to 1.62.

What is claimed is:

1. Method for coating yarn, comprising:

placing the yarn in contact with a dispersion comprising a coating agent and a dispersing agent, forming a coating on the yarn by at least partially removing the dispersing agent by heating, and cooling down and winding the coated yarn, wherein the coated yarn is further cooled before winding, and wherein the coating agent is applied to the yarn in an amount of from 10 wt. % to 800 wt. % of the yarn.

2. Method as in claim 1, wherein the further cooling is carried out by a water-cooled entanglement jet.

3. Method as in claim 1, wherein the coating of the yarn is part of a draw or spin-draw process and the heat for removing the dispersing agent is supplied during a relaxation step.

4. Method as in claim 1, wherein contact is made between the yarn and the dispersion by guiding the yarn through the dispersion.

5. Method as in claim 4, wherein the dispersion is in a container through which the yarn is guided.

6. Method as in claim 1, wherein the yarns are made from thermoplastic polymers.

7. Method as in claim 6, wherein the yarns are made essentially of polyethylene terephthalate.

8. Method as in claim 1, wherein forming the coating is carried out continuously at speeds of between 50 and 1000 m/min.

9. Method as in claim 1, wherein the coating agent is a polymer selected from a group consisting of silicone, polyurethane, polyolefin, polyacrylate, polyvinyl compounds, copolymers thereof and blends thereof.

10. Method as in claim 1, wherein the coating agent is polyvinyl chloride.

11. Method as in claim 1, wherein the dispersing agent is water.

12. Method as in claim 1, wherein prior to the placing the yarn in contact with the dispersion, the yarn is untwisted.

13. Coated yarn obtained by the method as in claim 1, wherein a refractive index of the coating agent, measured at a wavelength of a D line of sodium, differs from a refractive index of the yarn by no more than 0.01.

14. Coated yarn as in claim 13, wherein the refractive index of the yarn is an isotropic refractive index of the yarn.

15. Fabric containing coated yarn as specified by claim 1.

16. Method as in claim 5, wherein rolls guide the yarn through the container.

17. Method as in claim 6, wherein the thermoplastic polymers are selected from a group consisting of polyamide, polyester, polyolefin, copolymers thereof and blends thereof.

18. Coated yarn as in claim 13, wherein the refractive index of the coating agent differs from the refractive index of the yarn by no more than 0.001.

19. Fabric as in claim 15, wherein the fabric is a woven fabric or a nonwoven fabric.

20. Method as in claim 1, wherein following the placing of the yarn in contact with the dispersion and prior to the forming the coating, the method further comprises scraping excess dispersion off the yarn.

* * * * *